United States Patent [19]

Cooper

[11] Patent Number: 4,792,038

[45] Date of Patent: Dec. 20, 1988

[54] BASKET-TYPE CARRIER FOR ARTICLES OF VARIOUS SIZES

[75] Inventor: Leonard M. Cooper, West Monroe, La.

[73] Assignee: Manville Corporation, Denver, Colo.

[21] Appl. No.: 126,519

[22] Filed: Nov. 30, 1987

[51] Int. Cl.[4] ..... B65D 75/00

[52] U.S. Cl. ..... 206/180; 206/188; 206/427; 229/52 BC

[58] Field of Search ..... 206/171, 172, 173, 162, 206/175, 180, 188, 194, 427; 229/52 B, 52 BC

[56] References Cited

U.S. PATENT DOCUMENTS

| | | | |
|---|---|---|---|
| 2,644,631 | 7/1953 | Petter | 229/52 BC |
| 2,646,918 | 7/1953 | Forrer | 229/52 BC |
| 3,365,098 | 1/1968 | Sims | 206/188 |
| 3,572,545 | 3/1971 | Stout | 206/188 |
| 3,814,237 | 6/1974 | Forrer | 206/167 |
| 3,901,386 | 8/1975 | Hennessey | 206/427 |
| 4,029,205 | 6/1977 | Wood | 206/173 |
| 4,308,950 | 1/1982 | Wood | 206/188 |
| 4,402,400 | 9/1983 | Stout | 206/188 |

*Primary Examiner*—David T. Fidei
*Attorney, Agent, or Firm*—John D. Lister

[57] ABSTRACT

A basket-type carrier in which the cells are longer than they are wide in order to receive articles which are elongated in transverse cross section. The blank for forming the carrier contains spaced centrally located support panel sections which are foldably connected to riser panel sections and to the ends of partition straps. The folds connecting the center support panel sections to the partition straps are located between the folds connecting the side panels to the end panel sections and the folds connecting the end panel sections to the riser panel sections.

12 Claims, 4 Drawing Sheets

BASKET-TYPE CARRIER FOR ARTICLES OF VARIOUS SIZES

FIELD OF THE INVENTION

This invention relates to basket-type article carriers. More particularly, it relates to a basket-type carrier adapted to carry articles which are of different cross-sectional shape.

BACKGROUND OF THE INVENTION

Basket-type carriers are commonly used to carry articles of similar shape. Most articles are of uniform dimension in cross section, that is, they have either a circular or square cross-sectional shape. Beverage bottles or paper cartons which contain beverages are examples of such articles. In such designs the partition straps that divide the basket portion of the carrier into cells for receiving individual articles are approximately as long as the diameter or width of the articles, and they are spaced from the end panels of the carrier, as well as from each other, a similar distance. The resulting cells are thus able to snugly receive the articles.

In some production blanks from which basket-type carriers are formed partition straps defining the cells are foldably connected to the center support panel or handle panel. Examples of such an arrangement are disclosed in U.S. Pat. No. 3,814,237 to Forrer, which discloses a carrier having eight cells, and U.S. Pat. No. 4,402,400 to Stout, which discloses a carrier having six cells. In both disclosures partition straps extend from the side panels of the carrier to each side of the center handle support panel so as to form cells on each side of the carrier, two between the straps and the end panels and either one or two between the straps themselves, depending on whether the carrier has three or four cells on each side of the center support panel. The straps are foldably connected to the side panels as well as to the center handle support panel. The length of the partition straps, or the depth of the cells, is equal to one-half the width of the end panels, and the length of the center support panel is equal to the length of the side panels. The center support panel sections from which the center support panel is formed occupy the central area of the blank and are contiguous.

Another style of basket-type carrier employs a keel panel to which transverse partitions are connected to form the individual cells of the carrier. This design, which is illustrated by U.S. Pat. No. 4,308,950, requires a blank which uses more paperboard than does the type of carrier discussed above.

As a greater variety of materials are packaged in containers which lend themselves to being marketed in basket-type carriers, there is a demand for carriers which can hold such containers. At times, however, not all of the containers sold as a group are of the same cross-sectional shape. For example, although it may be desirable to sell necked plastic containers of motor oil in basket-type carriers, the best marketing strategy may be to include an oil filter in the same carrier. Because the shape of the filter is considerably different from the shape of the oil containers, currently available carriers would not allow such marketing strategies to be implemented. Complicating the problem is the fact that the necked plastic oil containers may not be of uniform cross section but may be elongated in transverse cross section, requiring that the carrier be able to hold not only different size containers but also containers of different cross-sectional shape.

It would be desirable to be able to package containers of different shapes in a basket-type carrier incorporating cells shaped to snugly receive the containers, wherein the carrier is formed from a blank using as little an amount of paperboard as possible. It would further be desirable to use such a basket-type carrier to package containers that do not have uniform cross-sectional dimensions.

BRIEF SUMMARY OF THE INVENTION

This invention permits a basket-type carrier to be used to package articles of different sizes and allows the carrier to be formed from a blank of minimal size. Partition straps are foldably connected to a center support panel to the side panels of the carrier. The distance between one of the end panels on one side of the center support panel and the nearest partition strap is substantially less than the distance between one of the end panels on the other side of the center support panel and the nearest partition strap, whereby one of the cells of the carrier is substantially wider than other cells of the carrier. In addition, the partition straps may be substantially greater in length than the width of the relatively narrow cells so as to be able to receive articles which are elongated in transverse cross section.

The blank from which the carrier is formed comprises a generally rectangular sheet to which transversely extending bottom panel sections are foldably attached. Riser panel sections at opposite margins of the sheet are foldably connected to end panel sections located in the corner areas of the sheet inwardly of the riser panel sections. The end panel sections are foldably connected to side panels. Inner and outer center support panel sections are located adjacent to the riser panel sections and extend toward each other inwardly of the riser panel sections. One of the side panels is longer than the other side panel and one of the riser panel sections nearest the longer side panel is narrower than the adjacent riser panel section nearest the other side panel. With this arrangement a carrier formed from the blank is divided into cells, one of which has a greater width, as measured along the side panels of the carrier, than the width of the other cells. By connecting the partition straps to the center support panel sections by fold lines located between the fold lines connecting the side panels to the end panel sections and the fold lines connecting the end panel sections to the riser panel sections, the cells in the carrier formed from the blank are deeper than they are wide and can thus receive articles which have an elongated transverse cross-sectional shape.

Other features and aspects of the invention, as well as its various benefits, will become more clear in the detail description of the preferred embodiment which follows.

DESCRIPTION OF THE PREFERRED EMBODIMENT

Figure 1:
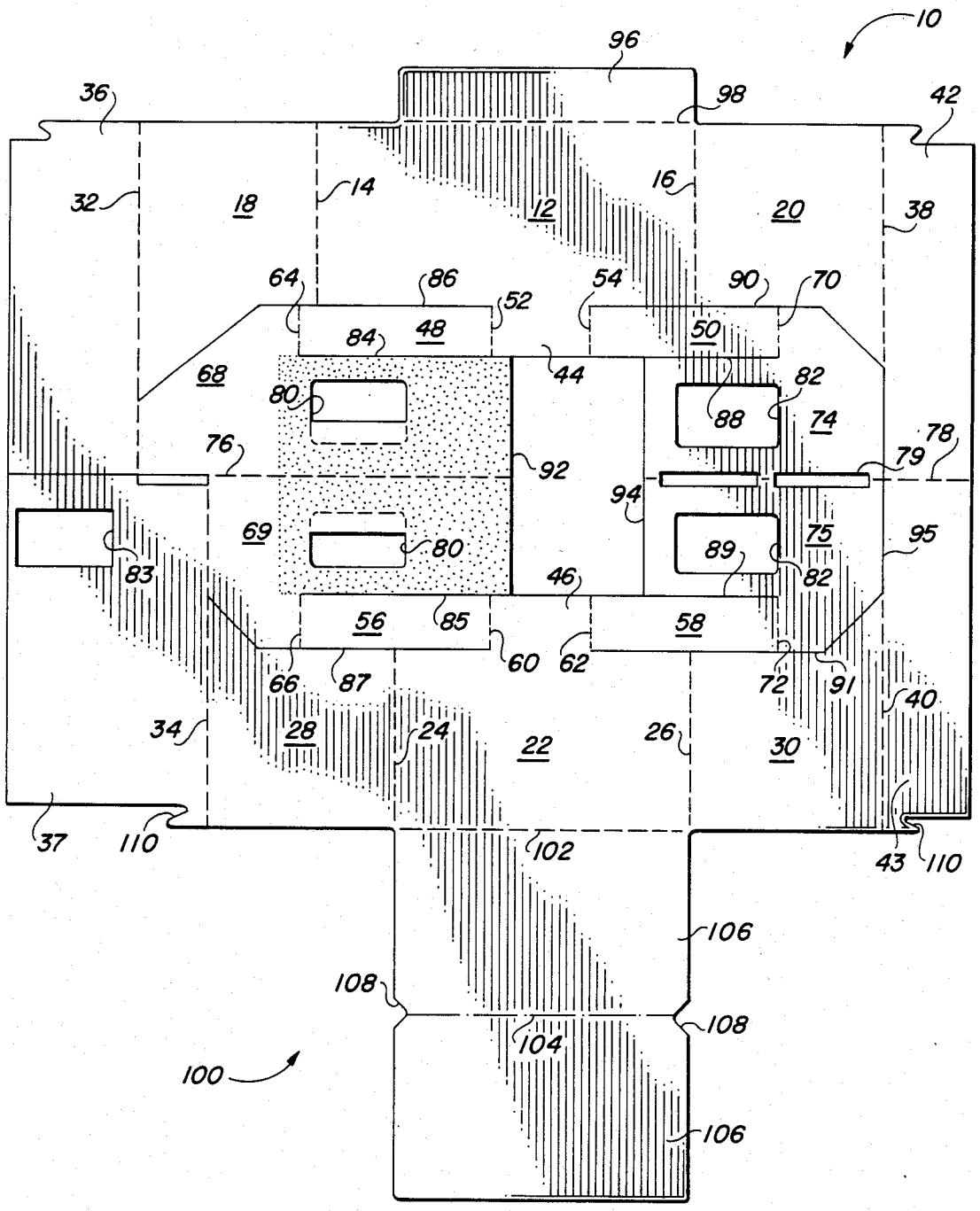
FIG. 1 is a plan view of a blank for forming a basket-type carrier in accordance with the present invention.

Referring to FIG. 1, a production blank 10 having a main body portion of generally rectangular shape, the inside surface of which faces the viewer, comprises a side panel 12 connected by fold lines 14 and 16 to end panel sections 18 and 20, respectively. Similarly, a second side panel 22 is connected by fold lines 24 and 26 to end panel sections 28 and 30, respectively. End panel sections 18 and 28 are connected by fold lines 32 and 34 to riser panel sections 36 and 37, respectively, while end panel sections 20 and 30 are connected by fold lines 38 and 40 to riser panel sections 42 and 43, respectively. The fold lines 16 and 26 as well as fold lines 38 and 40 are aligned, whereas the corresponding fold lines 14 and 24 and fold lines 32 and 34 are not aligned. This arrangement causes the side panel 12 to be longer than the side panel 22, and the riser panel 37 to be wider than the riser panel 36.

The side panels 12 and 22 include rectangular projections 44 and 46, respectively, extending toward each other in opposed relationship. Partition straps 48 and 50 are connected to the side edges of the projection 44 along fold lines 52 and 54, and partition straps 56 and 58 are connected to the side edges of the projection 46 along fold lines 60 and 62. The opposite ends of partition straps 48 and 56 are connected along fold lines 64 and 66 to outer center support panel sections 68 and 69. Similarly, the opposite ends of partition straps 50 and 58 are connected along fold lines 70 and 72 to inner center support panel sections 74 and 75. A fold line 76 separates the outer center support panel sections 68 and 69 and is located on the centerline of the generally rectangular portion of the blank 10. A fold line 78 which is aligned with fold line 76 also divides the riser panel sections 42 and 43 and the inner center support panel sections 74 and 75, the portion of the fold line 78 separating the inner support panel sections 74 and 75 being interrupted by cutouts 79 for ease of folding. The riser panel sections 42 and 43 are mirror images of each other, as are the inner center support panel sections 74 and 75. The riser panel sections 36 and 37 and the outer center support panel sections 68 and 69 are of different shape, however, owing to the different lengths of the side panels 12 and 22. The difference in width between the riser panel sections 36 and 37 is the same as the difference in length between the side panels 12 and 22 and the difference in length between the outer center support panel sections 68 and 69. The outer and inner support panel sections contain handle openings 80 and 82 on opposite sides of the fold lines 76 and 78, and the riser panel section 37 contains a handle opening 83 of corresponding size to permit a handle opening to be formed in the finally formed multi-ply center support panel as explained below.

Partition straps 48 and 56 are separated from the outer center support panel sections 68 and 69 by slits 84 and 85, and from end panel sections 18 and 28 and side panels 12 and 22 by slits 86 and 87. The slits 86 and 87 also extend beyond the fold lines 64 and 66 and angle toward each other until they terminate at the fold lines 32 and 34. The angled slit portions are part of the top edges of the end panels of the carrier formed from the blank. In like manner, partition straps 50 and 58 are separated from inner center support panel sections 74 and 75 by slits 88 and 89, and are also separated from end panel sections 20 and 30 and side panels 12 and 22 by slits 90 and 91. As in the case of the slits 86 and 87, the slits 90 and 91 extend beyond the fold lines 70 and 72 and angle toward each other until terminating at the fold lines 38 and 40. The angled portions of slits 90 and 91 are part of the top edges of the opposite end panels of the carrier formed from the blank. The interior ends of outer center support panel sections 68 and 69 terminate in an edge 92 in the central portion of the blank 10, and the interior ends of inner center support panel sections 74 and 75 terminate in the central portion of the blank in edge 94 spaced from the edge 92. The outer ends of the outer center support panel sections 68 and 69 are foldably connected to the fold lines 32 and 34 on either side of the fold line 76. The outer ends of the inner center support panel sections 74 and 75 terminate in a slit 95 which separates the sections 74 and 75 from the riser panel sections 42 and 43 on either side of the fold line 78, the slit 95 being aligned with the fold lines 38 and 40.

A glue flap 96 is connected to the outer edge of the side panel 12 by a fold line 98, and bottom panel 100 is connected to the outer edge of the side panel 22 by fold line 102. The bottom panel 100 is divided in half by score line 104 to form two bottom panel sections 106. The bottom panel may be noted at the ends fo the score line 104 as at 108 for subsequent engagement with hooks or tabs formed from cutouts 110 in the riser panel sections. The bottom panel sections thus are connected so as to extend transversely of the generally rectangular main body portion of the blank.

Figure 2:
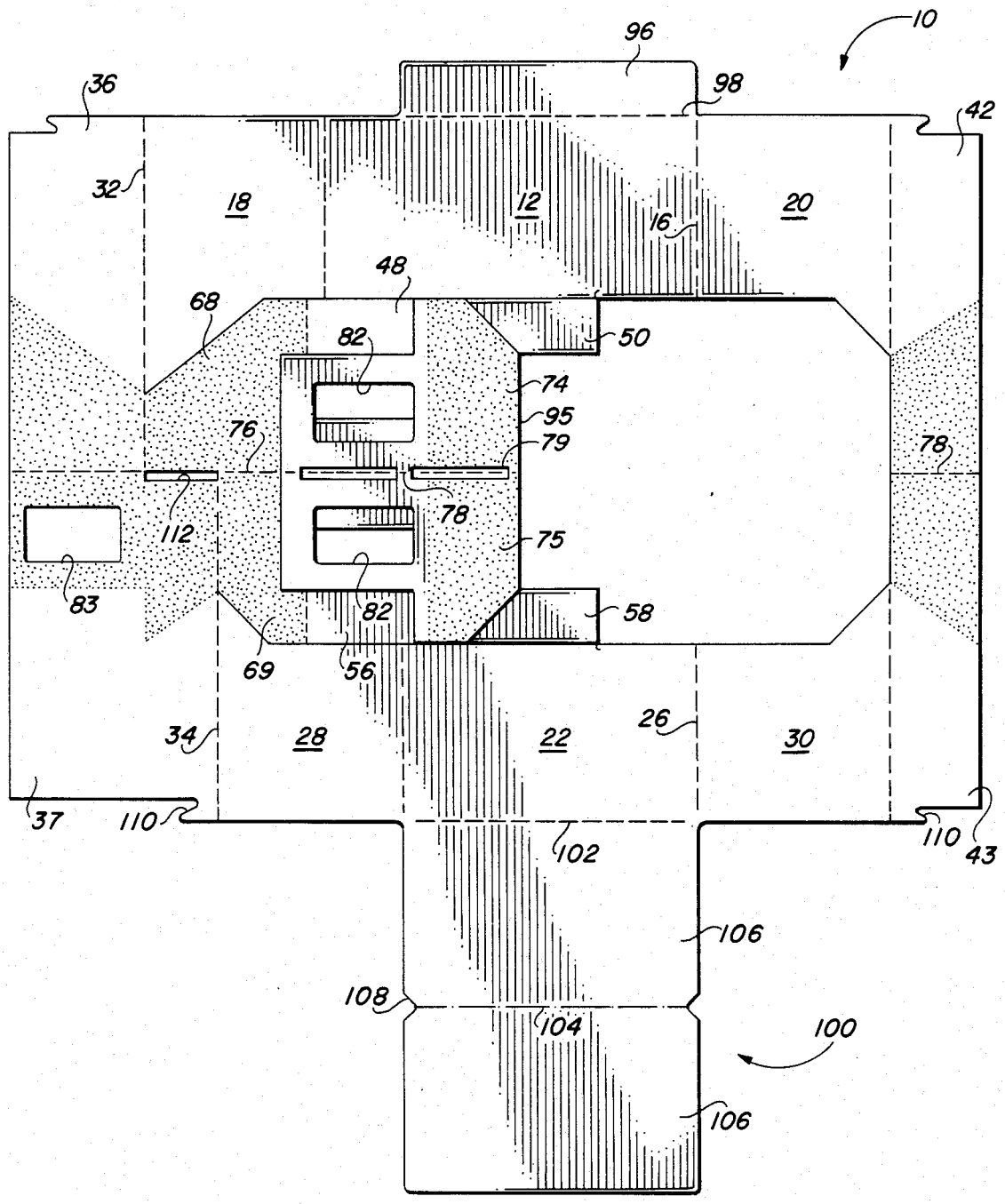
FIGS. 2, 3 and 4 are plan views of the blank of FIG. 1 in subsequent stages of formation in the forming of a basket-type carrier.

To form the carrier, adhesive is first applied to the outer center support panel sections 68 and 69 in the stippled area shown in FIG. 1. The inner support panel sections 74 and 75 are then elevated out of the plane of the blank, causing the partition straps 50 and 58 to pivot upwardly about their fold lines 54 and 62. At the same time the sections 74 and 75 are caused to remain substantially parallel to the plane of the blank by relative downward pivoting movement between the sections 74 and 75 and the fold lines 70 and 72 at the opposite ends of the partition straps 50 and 58. The end result of these movements is to pivot the inner center support panel sections 74 and 75 so that the outer surfaces thereof are engaged with the stippled inner surfaces of the outer center support panel sections 68 ad 69, the handle openings 80 and 82 being aligned with each other as shown in FIG. 2. The length of the outer center support panel section 68 is equal to the length of the side panel 12, and the length of the outer support panel section 69 is equal to the length of the side panel 22. Both outer center support panel sections 68 and 69 are longer than the inner center support panel sections 74 and 75. The shorter length of the sections 74 and 75 allows space for the subsequent folding of the riser panel sections 36 and 37.

Still referring to FIG. 2, the next step in the formation of the carrier is to apply adhesive to the stippled areas of the center support panel sections 68, 69, 74 and 75, as well as to the stippled areas of the central portions of the riser panel sections 36, 37, 42 and 43. The riser panel sections 36 and 37 are then folded along fold lines 32 and 34 so as to engage the sections 68 and 69, and the end panel sections 20 and 30 are folded along fold lines 16 and 26 to cause the riser panel sections 42 and 43 to engage the inner center support panel sections 74 and 75. A cutout 112 in the riser panel section 37 at the corner thereof extending between the inner ends of fold lines 32 and 34 is aligned with the fold lines 76 in the riser panel sections 68 and 69 to reduce the layers of material at this point so as not to interfere with the subsequent folding process.

Figure 3:
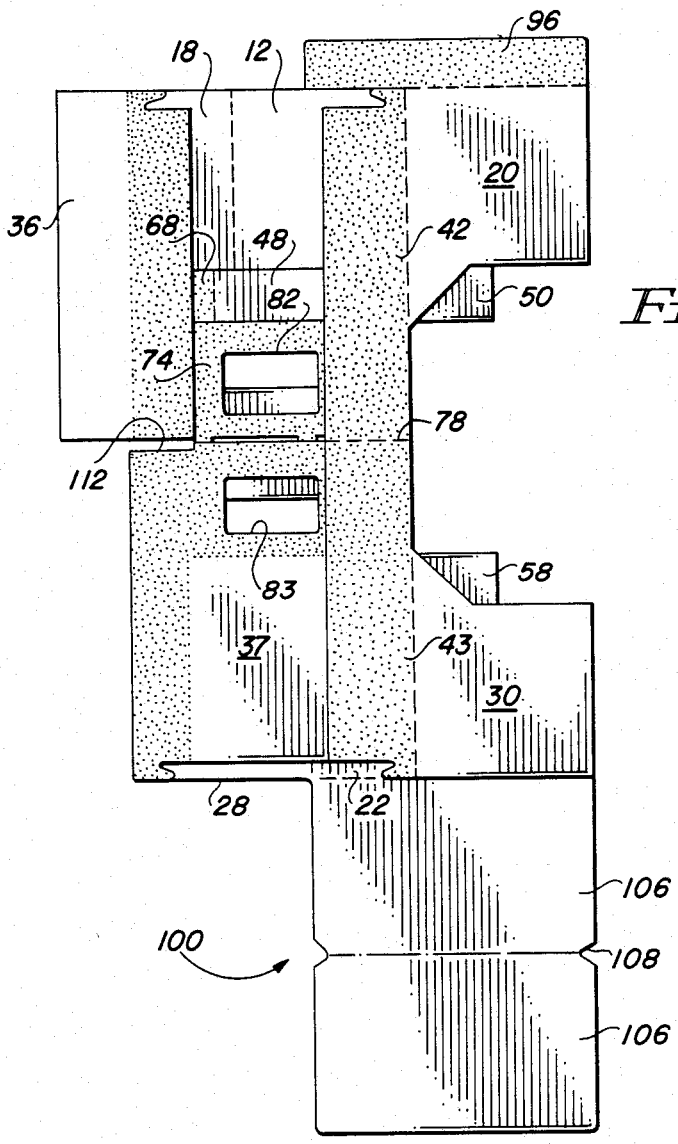

The result of this action is illustrated in FIG. 3. The next step in the formation of the carrier is to apply adhesive to the stippled areas of the riser panel sections 36, 37, 42 and 43, the exposed surfaces of center support panel sections 68 and 74, and the glue flap 96. The partially folded blank is then folded along fold lines 76 and 78 to adhere the riser panel sections and the center support panel sections together. In addition, the lowermost bottom panel section 106 is first folded upwardly about fold line 104 so that the glue flap 96 contacts the opposite side of the edge portion of the lowermost bottom panel section after it has been folded up.

Figure 4:
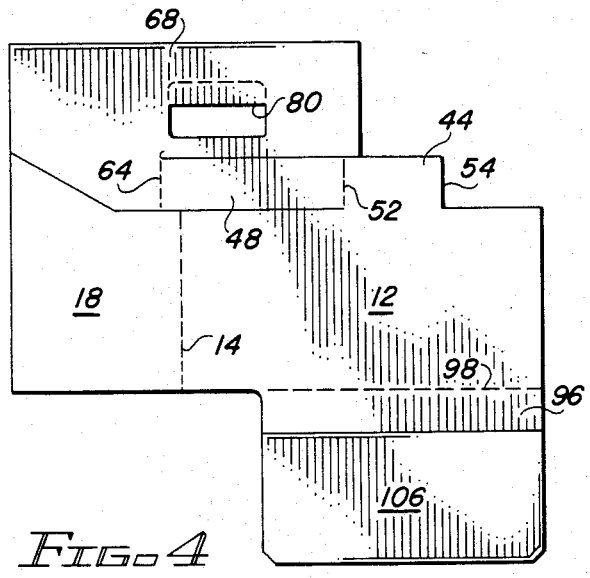

These folding and gluing actions complete the formation of the semi-formed blank, which is shown in FIG. 4. The center support panel is now comprised of four to six plies or paperboard, depending upon the point at which the thickness is measured, and the riser panels are comprised of at least two plies. The partition straps are not glued to any structure, but are foldably connected at their ends as explained above, the single strap visible in this view being strap 48. The folded and glued blank may be shipped in this condition to the packaging facility where the blank is opened to receive articles by applying pressure in an inward direction to the side edges of the blank. This action squeezes the folded blank into the carrier form shown in FIGS. 5 and 6. It should be understood that the recesses 110 at the bottom of the riser panels are mated with the notches 108 at the center edges of the bottom panel of the carrier to mechanically support the bottom of the carrier.

Figure 5:
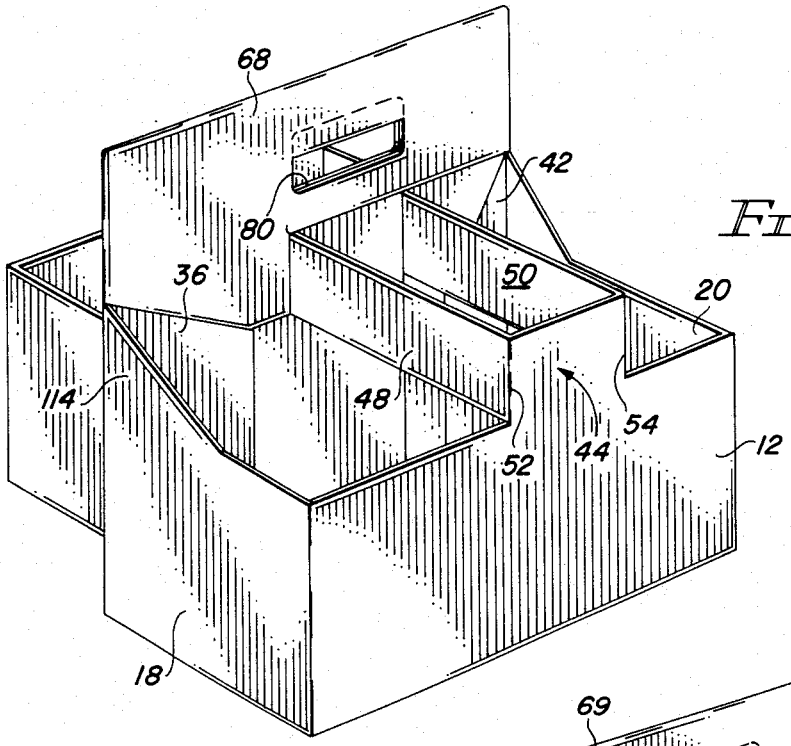
FIG. 5 is a pictorial view showing one side of a carrier formed in accordance with the invention.

As shown in FIG. 5, the resulting carrier has partition straps 48 and 50 foldably connected to and extending between the center support panel 68 and the side panel 12. The straps are connected to the vertical edges 52 and 54 of the projecting portion 44 of the side panel 12 so that the straps, which form the side partitions of the center cell, are located above the main body of the side panel. The riser panels 36 and 42 extend a substantial distance inwardly from the center fold 76 of the end panel sections 18 and 28 to provide added support for the containers. Also, the portions of the end panels adjacent the riser panels extend upwardly to form the triangular portions 114 which terminate at the same height as the tops of the partition straps and serve to provide added support to the containers in the end cells. The triangular portions are formed as a result of the angled portions of the slits 86, 87, 90 and 91 discussed previously. It can be seen that the cell between partition strap 50 and end panel 20 and the cell between the partition straps 48 and 50 are of similar size, the length or depth of the cells being substantially longer than their width. The cell between the partition strap 48 and end panel 18, on the other hand, is considerably larger and is illustrated as being of generally uniform cross-sectional dimensions.

Figure 6:
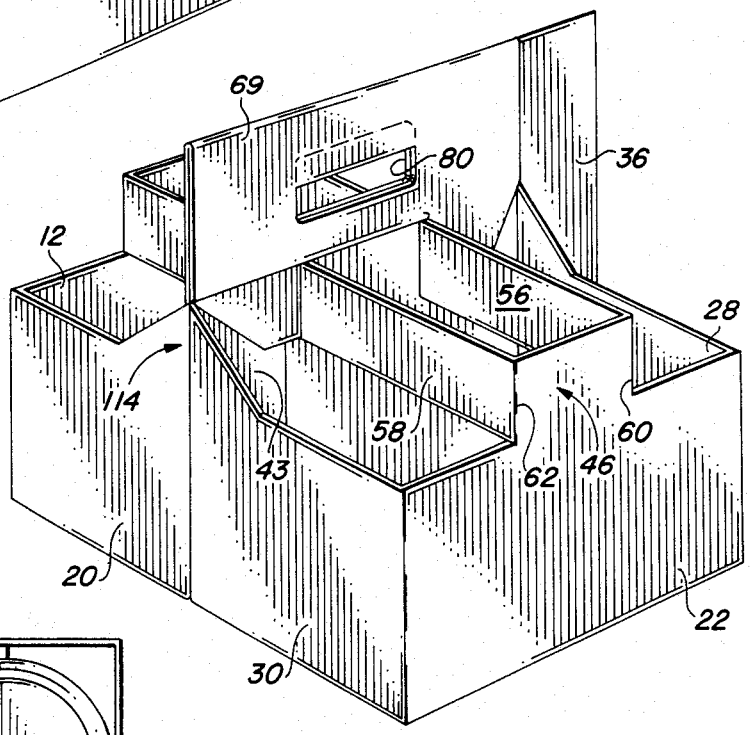
FIG. 6 is a pictorial view similar to that of FIG. 5, but showing the other side of the carrier.

As shown in FIG. 6, the other side of the carrier contains three cells of similar shape to that of the smaller cells shown in FIG. 5. This leaves a blank space on the side of the carrier opposite the outer portion of the large cell so that the end panel 28 is offset from the edge of the riser panel 36.

Although not specifically shown in the drawings, it can be seen that the bottom panel of the carrier will be as wide as the length of side panel 22, to which the bottom panel section 106 is connected. There would thus be a space between the edge of the bottom panel and the end panel 18 equal to the difference in length between the side panels. If desired, the bottom panel section 106 remote from the panel 22 could be made wider, up to the length of the side panel 12, so as to provide a bottom panel which extends all the way to the end panel 18.

Figure 7:
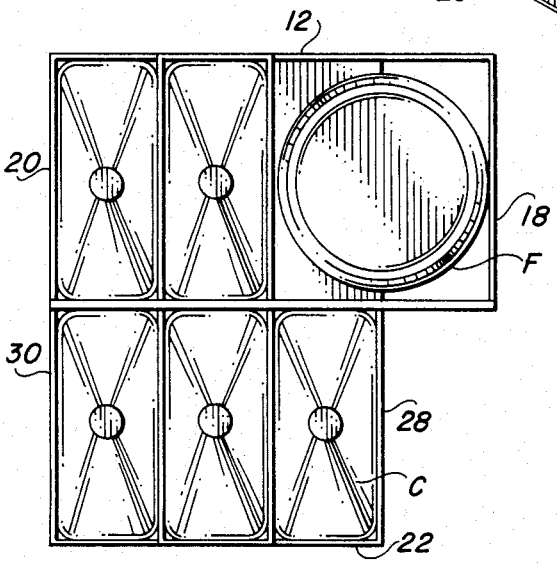
FIG. 7 is a top view of the carrier of FIGS. 5 and 6, shown with elongated containers in five of the cells thereof and a larger cylindrical article in the sixth cell.

As illustrated more clearly in FIG. 7, five of the cells of the carrier shown in FIGS. 5 and 6 are adapted to hold containers which in transverse cross section are about twice as long as they are wide. The other cell is adapted to hold a larger article of more regular cross-sectional dimensions, such as the cylindrical shape shown. These dimensions would allow the carrier to receive both elongated containers of oil and an oil filter.

It should now be clear that the present invention provides for a carrier adapted to hold containers of different cross-sectional shape, one of which shapes may be an elongated transverse cross-sectional shape. The carrier further is formed from a blank of minimum area, representing a significant cost saving.

It should now be obvious that although a preferred embodiment of the invention has been described, changes to specific details of the embodiment can be made without departing from the spirit and scope of the invention as defined in the appended claims.

What is claimed is:

1. A basket-type article carrier, comprising:

a bottom panel having side edges;

side panels foldably connected to the side edges of the bottom panel, the side panels having end edges;

end panels foldably connected to the end edges of the side panels;

riser panels connected to the end panels centrally of the end panels;

a center support panel connected to and extending between the riser panels;

at least one partition strap extending between the center support panel and each side panel to divide the carrier on either side of the center support panel into cells for receiving articles to be carried, the cells having a depth corresponding to the distance between the center support panel and the side panels and a width corresponding to the distance between the end panel and the partition straps nearest thereto;

the partition straps being connected by fold lines to the center support panel and to the associated side panel; and the distance between one of the end panels on one side of the center support panel and the nearest partition strap being substantially less than the distance between one of the end panels on the other side of the center support panel and the nearest partition strap, whereby one of the cells of the carrier is substantially wider than other cells of the carrier.

2. A basket-type article carrier according to claim 1, wherein one of the side panels is longer than the other side panel.

3. A basket-type article carrier according to claim 2, wherein the length of the center support panel is substantially equal to the length of the longer side panel.

4. A basket-type article carrier according to claim 2, wherein at least the cells other than the widest cell have a depth substantially greater than their width.

5. A basket-type article carrier according to claim 2, wherein the riser panels are substantially parallel to the side panels and form support surfaces for articles in cells adjacent the end panels, the riser panels at one end of the carrier being of greater width than the riser panels at the other end of the carrier.

6. A basket-type article carrier according to claim 4, wherein there are two partition straps extending between the center support panel and each side panel to form five cells of substantially equal width and one cell of substantially greater width.

7. A production blank for forming a basket-type article carrier, comprising:

a sheet having a generally rectangular main body portion;

riser panel sections at two opposite margins of the main body portion of the sheet;

end panel sections of substantially equal width in corner areas of the main body portion of the sheet adjacent to and inwardly of the riser panel sections, each end panel section being connected to the adjacent riser panel section by a fold line;

a pair of side panels connected to the end panel sections by fold lines substantially parallel to the fold lines connecting the riser panel sections to the end panel sections;

a pair of outer center support panel sections adjacent the riser panel sections at one margin of the main body portion of the sheet and a pair of inner center support panel sections adjacent the riser panel sections of the opposite margin, the two pairs of center support panel section extending toward each other between the end panel sections and the side panels;

bottom panel means extending transversely of the main body portion of the sheet and being connected to one of the side panels along a fold line;

partition straps connected to the side panels and to the center support panel sections by fold lines; and one of the side panels being longer than the other side panel, and one of the riser panel sections nearest the longer side panel having a width less than the width of the adjacent riser panel section nearest the other side panel; whereby when the blank is formed into a carrier, the carrier is divided into cells, one of which has a greater width, as measured along the side panels of the carrier, than the width of the other cells.

8. A production blank according to claim 7, wherein the fold lines connecting the partition straps to the center support panels are located between the fold lines connecting the side panels to the end panel sections and the fold lines connecting the end panel sections to the riser panel sections, whereby the depth of the cells other than the widest cell in a carrier formed from the blank is greater than the width thereof.

9. A production blank according to claim 8, wherein the outer and inner center support panel sections are spaced from each other.

10. A production blank according to claim 7, wherein the outer center support panel section adjacent the longer side panel is longer than the other outer center support panel section.

11. A production blank according to claim 10, wherein at least portions of the center support panel sections contain fold lines extending at right angles to the fold lines connecting the riser panel sections to the end panel sections.

12. A production blank according to claim 7, wherein the center support panel sections and at least the widest riser panel section contain handle openings positioned so as to register when the blank is folded to form a carrier.

* * * * *